United States Patent [19]

Killingstad

[11] Patent Number: 4,982,475

[45] Date of Patent: Jan. 8, 1991

[54] ARRANGEMENT IN A DOOR HINGE WITH TWO HINGE FLAPS AND AN ATTACHING PLATE FOR ONE OF SAID HINGE FLAPS

[76] Inventor: Tore Killingstad, Linjeveien 3, N-1084 Oslo 10, Norway

[21] Appl. No.: 393,853

[22] Filed: Aug. 11, 1989

Related U.S. Application Data

[62] Division of Ser. No. 154,153, Feb. 9, 1988, abandoned.

[30] Foreign Application Priority Data

Feb. 23, 1987 [NO] Norway ..... 870723

[51] Int. Cl.[5] ..... E05D 7/12

[52] U.S. Cl. ..... 16/257; 16/DIG. 43

[58] Field of Search ..... 16/254, 271, 272, 382, 16/DIG. 43, DIG. 40, 257, 249

[56] References Cited

U.S. PATENT DOCUMENTS

| | | | |
|---|---|---|---|
| 67,904 | 8/1867 | Ralph | 16/249 |
| 124,627 | 3/1872 | Rathknecht | 16/272 |
| 616,952 | 1/1899 | Morrison | 16/271 |
| 856,112 | 6/1907 | Tieck | 16/257 |
| 1,214,263 | 1/1917 | Barber | 16/258 |
| 3,423,786 | 1/1969 | Arlas, Jr. et al. | 16/257 |
| 3,728,758 | 4/1973 | Johansen | 16/257 |
| 4,535,502 | 8/1985 | Grass | 16/382 |

FOREIGN PATENT DOCUMENTS

| | | | |
|---|---|---|---|
| 202671 | 10/1908 | Fed. Rep. of Germany | 16/257 |
| 11241 | 5/1904 | United Kingdom | 16/254 |

*Primary Examiner*—Richard K. Seidel
*Assistant Examiner*—Carmine Cuda
*Attorney, Agent, or Firm*—Townsend and Townsend

[57] ABSTRACT

In order to retain an attaching plate so as to enable insertion from both sides for one hinge flap of a door hinge, against maladjustment when said plate is mounted in a milled recess at the edge of a door panel, at least one side of the attaching plate which extends in parallel with the direction of insertion provided with the shape of a circular arc, with the recess in the edge of the door panel having exactly the same shape. The attaching plate includes two opposed resilient panels having lugs which lock the hinge flap in position.

3 Claims, 2 Drawing Sheets

Figure 1:
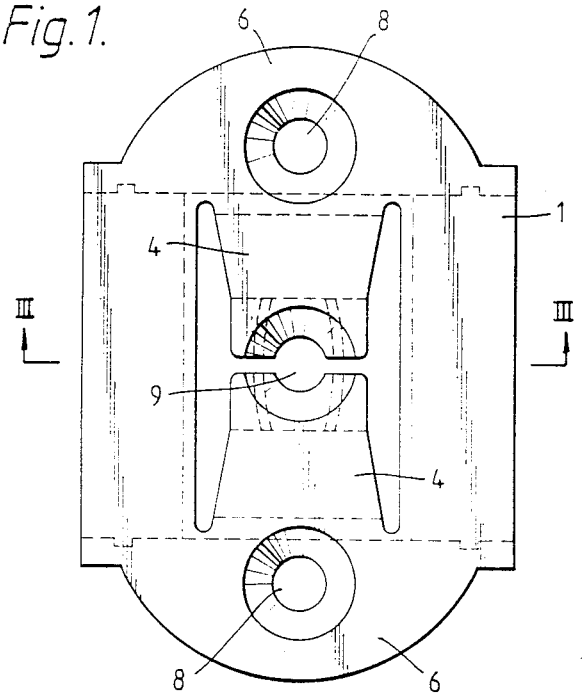

ARRANGEMENT IN A DOOR HINGE WITH TWO HINGE FLAPS AND AN ATTACHING PLATE FOR ONE OF SAID HINGE FLAPS

This is a division of application Ser. No. 154,153, filed Feb. 9, 1988, now abandoned.

The present invention relates to an arrangement in a door hinge comprising two hinge flaps and an attaching plate for one of the flaps, said hinge flap having the shape of a tongue which fits in the attaching plate, optionally, from one or the other side, which are both open when the attaching plate is mounted on the edge of a door, said tongue being held securely by locking means in the plate. Furthermore, the invention relates to a method of milling in the edge of a door for mounting said attaching plate.

Door hinges known by the trade mark "SNAP-IN" comprise two joined hinge flaps one of which hinge flaps is intended for being screwed into a milled recess in a door frame in a manner known per se, and the other hinge flap is in the shape of a tongue which—when the door is mounted—is inserted into an attaching plate which is screwed into a milled recess in the door and which forms a pocket with said recess into which the tongue fits. The tongue has locking means cooperating with corresponding locking means on the attaching plate, e.g. in the shape of an aperture in the tongue, and a resilient pawl in the attaching plate. With such a design of the door hinge a door can readily be rehinged from a right-hand to a left-hand arrangement, or vice versa, by moving the hinges from one side of the door frame to the other and turning the door panel about its own plane. The top half of the door panel with one hinge will, thus, become the lower half with the other hinge, and vice versa. This is rendered possible by a symmetrical arrangement of the bores for door handle and keyhole. This door hinge arrangement is much used because mounting is simple, and a door can be rehinged as desired, an operation that can also be performed by unskilled labour.

This possibility of rehinging, known per se, however, requires identical, and preferably smooth halves of the door panels. In our nostalgic times, however, panelled doors are becoming fashionable, and in many designs the patterns of panels is such that the door cannot be turned about a line that is normal to the plane of the door panel. The same problem will arise in case of doors that are provided with panes, especially panes with etched ornaments or lead glass provided considerably to its lower edge. If such doors are to be rehinged it must be possible to turn them about a line in the plane of the door panel. Efforts were made to render this possible by the aid of a square attaching plate having a width equal to the thickness of the door panel and by enabling insertion of the tongue shaped hinge flat from both sides of the attaching plate. In case of rehinging the top half or lower half of the doors the door panel will then not change places. In order to ensure a satisfactory effect of this operation it is, however, necessary that the attaching plate is very accurately mounted "side-by-side" with the lateral faces of the door panel. This is time consuming work necessitating a high degree of carefulness, since both drilling of screw holes and screwing wood screws into the wooden door material can easily cause deviations from the assumed line because properties of the wood material are not homogeneous all over.

It is, thus, an object of the present invention to provide an arrangement in hinges of the mentioned kind, especially of the attaching plate, which will largely reduce, and even eliminate the hazard of mounting errors. By the aid of a quick milling tool very accurate milled recesses can be made in the wooden material, and this fact is utilized in the present invention, as the attaching plate and the milled recess for it should have such a shape that the parts are locked together in a carefully determined position already before the attaching plate is secured by screwing wood screws into bores.

With a double set of locking means in the plate the tongue-shaped hinge flap will, additionally, be well fastened, and besides, the milling operation is simple and quick.

Figure 2:
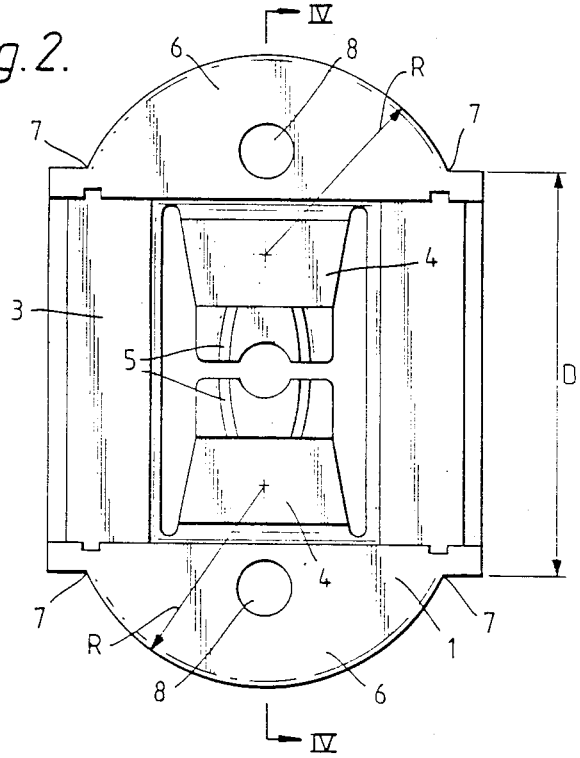
Figure 3:
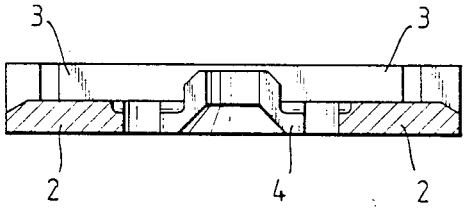
Figure 4:
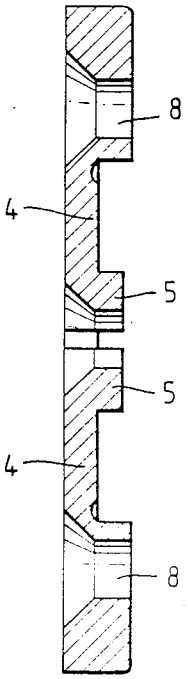

The invention is characterized by the features stated in the claims and will be disclosed in more detail below with reference to the drawings, wherein FIG. 1 shows an attaching plate according to the invention in a front view, FIG. 2 shows the attaching plate as seen from the rear side which will face the door panel when the plate is mounted, FIG. 3 is a sectional view of the attaching plate taken along line III—III in FIG. 1, FIG. 4 is a section along line IV—IV in FIG. 2, and FIG. 5 shows the principle of the method for milling a recess for the attaching plate in FIGS. 1–4, according to the invention.

Attaching plate 1, as shown in FIG. 1, has a plane front face 2 (FIG. 3) which, when mounted in a milled recess in the edge of a door panel, is to be in alignment with that recess. A covering plate can be provided to conceal the attaching plate. On the rear side attaching plate 1 has a passage or a pocket 3 one lateral wall of which is formed by the bottom of the recess in the lateral edge of the door panel. The pocket will permit insertion of the hinge flap forming the door hinge and being shaped as a tongue fitting into passage or pocket 3. This principle is previously known. According to the invention attaching plate 1 is provided with two opposed pawls 4 which are resilient and show lugs 5 which lock the tongue shaped hinge flap in place, snapping in place due to spring force after the pawls 4 are lifted from an inclination on the tongue shaped hinge flap, not shown. Pawls 4 are provided with recesses 9 being receptive of receiving a screw head. To provide milled recess in the edge of the door panel, upper and lower sides are in FIG. 1 provided with an arc 6 fitting into a curved portion of the recess in the edge of the door panel that is shown in FIG. 5 and disclosed in more detail below.

FIG. 2 shows the side of attaching plate 1 which is to face the bottom of the recess in the edge of the door panel, and it is possible to see passage 3, and the resilient pawls 4 with lugs 5, and the arcuate enlargements 6 at the upper and lower edge in the Figure. Due to the fact that the upper and lower edge deviate from the linear shape the attaching plate will be locked in recesses in the edge of the door panel when said recess fits tightly to the attaching plate. A characteristical feature of the invention is that the radius R of the arcuate portion 6 is half the dimension D, which is the width of the rectangular portion of the attaching plate, said arc terminating inside the parallel lateral edges, as shown at 7. The object of this arrangement is simplification of the milling in the edge of the door panel.

Attaching plate 1 is provided with screw holes 8 for receiving screw at recesses 6 for securing the attaching plate to the door panel. This is especially important in case of fire doors, since a direct metal connection is then achieved between the hinge flap and the door frame even if the attaching plate should soften or melt in a fire.

In FIG. 5 a portion 10 of the lateral edge of a door panel is shown enlarged and it is shown by the aid of thin lines how recesses 14 and 16 may be formed. This allows the attaching plate of FIGS. 1–4 to fit tightly, without being able to move across the edge of the door panel 10. In position 11 the rotating milling tool has started milling in the door panel and the milling tool continues with a rectilinear movement, as indicated by arrow 12. When the axis of rotation has reached the tip of arrow 12, the milling tool is at the center of the lateral edge, and is moved upwards as shown by arrow 13 to form the arcuate portion of the recess. Then the rotating milling tool is moved back to pass the central position, and continues along arrow 15 to provide the opposite recess 16. The milling tool is, again, returned to the central position and will now continue through the material of the door panel along arrow 17. When the axis of rotation of the milling tool has reached the tip of arrow 17 the milling operation is completed. It will appear that one and the same milling tool can provide the recesses 14 and 16 by the aid of simple movements, and when the attaching plate according to FIGS. 1–4 is mounted with a tight fit screw holes are readily bored and screws are readily tightened without any possibility of displacement of the attaching plate in any direction.

Having described my invention, I claim:

1. An arrangement in a door hinge comprising an attachment plate and two hinge flaps, one of said hinge flaps having the shape of a tongue fitting slidably into a pocket in said attachment plate from either accessible sides when said attachment plate is positioned in milled recesses in the edge of a door, and with said tongue shaped hinge flap having an aperture and being retained in position in said attachment plate by locking means, said locking means characterized in that said attachment plate is provided with at least two opposed resilient pawls having lugs and ends, said opposed resilient pawls extending in a direction perpendicular to the direction of movement of said hinge flap having shape of a tongue, said lugs allowing locking said tongue shaped hinge flap in position by spring lock action between said lugs and said aperture in said tongue shaped hinge flap, and said ends of said opposed resilient pawls having recesses being receptive of receiving a screw head.

2. An arrangement in a door hinge comprising an attachment plate and two hinge flaps, one of said hinge flaps having the shape of a tongue fitting slidably into a pocket in said attachment plate from either accessible sides when said attachment plate is positioned in milled recess in the edge of the door, and with said tongue shaped hinge flap being retained in position in said attachment plate by locking means, characterized in that said attachment plate is provided with at least two opposed resilient pawls having lugs which locks the tongue shaped hinge flap in position by spring lock action between said lugs and grooves in said flap, ends of said opposed resilient pawls having recesses being receptive of receiving a screw head.

3. An arrangement as claimed in claim 1, characterized in that said tongue shaped hinge flap is provided with an inclined surface on its free end acting with at least two opposed inclined surfaces on said resilient pawls.

* * * * *